US005363992A

United States Patent [19]

Meshberg

[11] Patent Number: 5,363,992

[45] Date of Patent: Nov. 15, 1994

[54] VARIABLE SPRAY AND DOSAGE PUMP

[76] Inventor: Philip Meshberg, 2770 S. Ocean Blvd., Apt. 602, Palm Beach, Fla. 33480

[21] Appl. No.: 999,331

[22] Filed: Dec. 31, 1992

[51] Int. Cl.[5] ..... B65D 47/34

[52] U.S. Cl. ..... 222/309; 222/321

[58] Field of Search ..... 222/321, 309, 402.17

[56] References Cited

U.S. PATENT DOCUMENTS

| | | | |
|---|---|---|---|
| 3,083,872 | 4/1963 | Meshberg . | |
| 3,180,536 | 4/1965 | Meshberg . | |
| 3,492,876 | 2/1970 | Bull et al. | 222/309 X |
| 4,185,755 | 1/1980 | Sachs et al. | 222/309 X |
| 4,389,003 | 6/1983 | Meshberg . | |
| 4,433,799 | 2/1985 | Corsette | 222/309 |
| 4,445,626 | 5/1984 | Steffen et al. | 222/309 X |
| 4,454,964 | 6/1984 | Sacher | 222/309 X |
| 4,456,152 | 6/1984 | Young et al. | 222/309 |
| 4,467,942 | 8/1984 | Oshikubo | 222/309 X |
| 4,526,294 | 7/1985 | Hirschmann et al. | 222/309 X |
| 4,871,092 | 10/1989 | Maerte | 222/309 X |
| 5,007,757 | 4/1991 | Iizuka | 222/309 X |
| 5,050,782 | 9/1991 | Cheng | 222/309 |

*Primary Examiner*—Andres Kashnikow
*Assistant Examiner*—Kenneth De Rosa
*Attorney, Agent, or Firm*—Kenyon & Kenyon

[57] ABSTRACT

An apparatus for providing variable doses and variable spray patterns for a dispensing pump is disclosed. The actuator assembly can include two spray nozzles with different spray patterns, and a mechanism for allowing fluid communication between the pump interior and either one or the other of the two spray nozzles. The actuator assembly also includes a mechanism which limits the downstroke of the pump piston by providing a stop mechanism which limits downward depression of the actuator assembly.

18 Claims, 6 Drawing Sheets

VARIABLE SPRAY AND DOSAGE PUMP

BACKGROUND OF THE INVENTION

The present invention relates to atomizing pumps. In most atomizing pumps, the pump is provided with an actuator with a single spray outlet, which dispenses with a single spray pattern. Moreover, because the pump stroke is usually limited by contact between either the piston and the bottom of the pump housing or the bottom of the actuator and the mounting cup, the pump is usually designed to dispense a dose of one specific quantity.

SUMMARY OF THE INVENTION

The present invention is directed to a spray pump in which the pump actuator structure is designed to allow a plurality of different spray patterns from the same actuator, and which allows the operator to vary the dose which is dispensed by the pump. This is accomplished by providing an actuator structure which includes a stop mechanism which limits the pump stroke at different adjustment positions of the stop mechanism. The result of this structure is that there are different doses dispensed by the pump at the different positions of the stop mechanism. At least one position of the stop mechanism can incorporate a locking feature, which prevents any actuation of the actuator, and thus prevents dispensing from the pump. The actuator may also incorporate more than one spray nozzle, to provide a variety of different spray patterns from the actuator.

DETAILED DESCRIPTION

Figure 1:
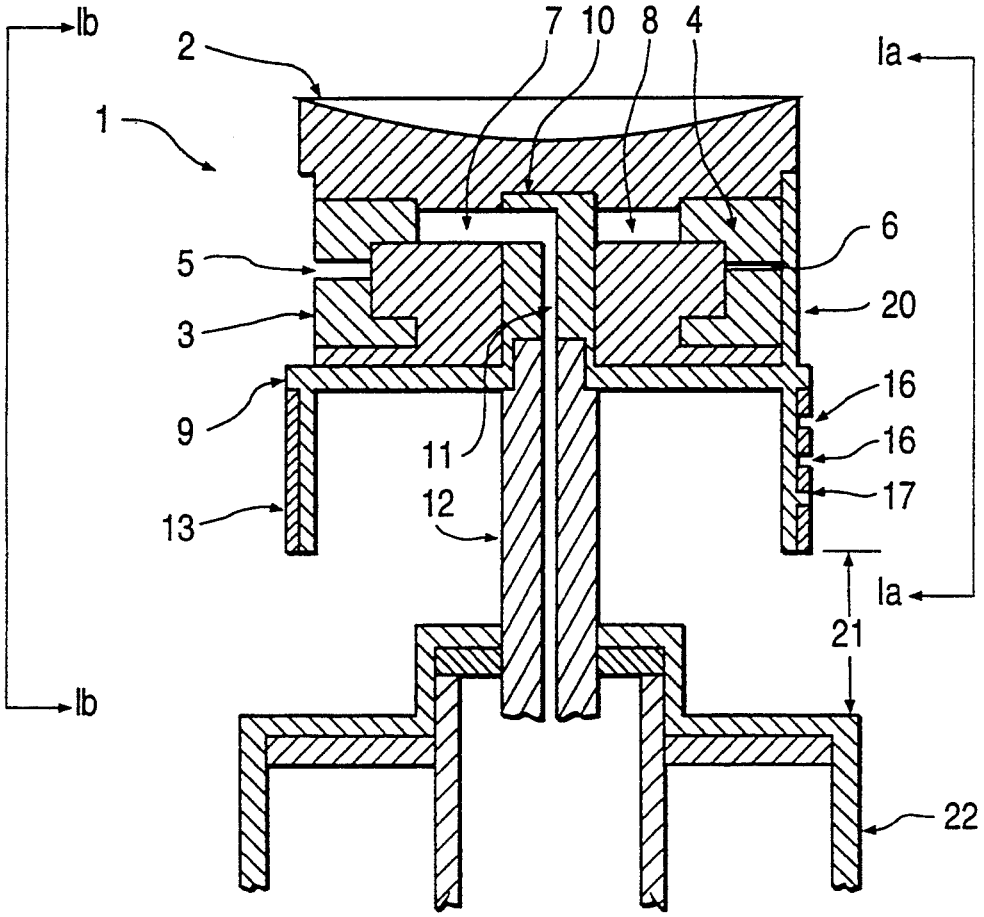
FIG. 1 shows a cross-sectional view of a first embodiment of the present invention.
Figure 1A:
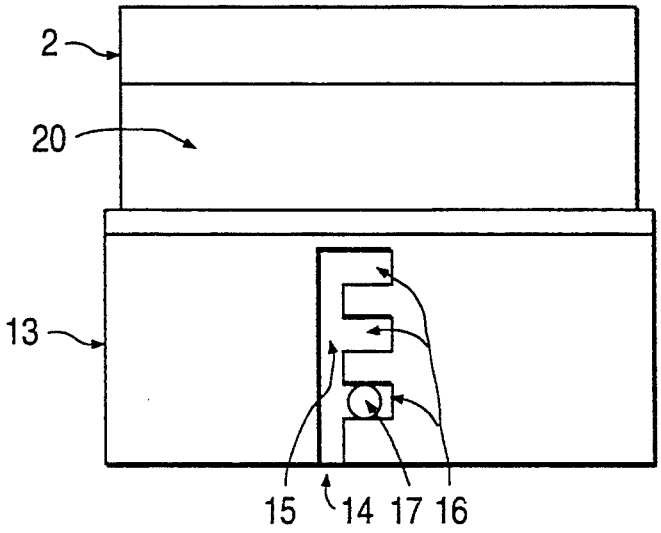
FIGS. 1*a* and 1*b* show side views of the first embodiment of the present invention.
Figure 1B:
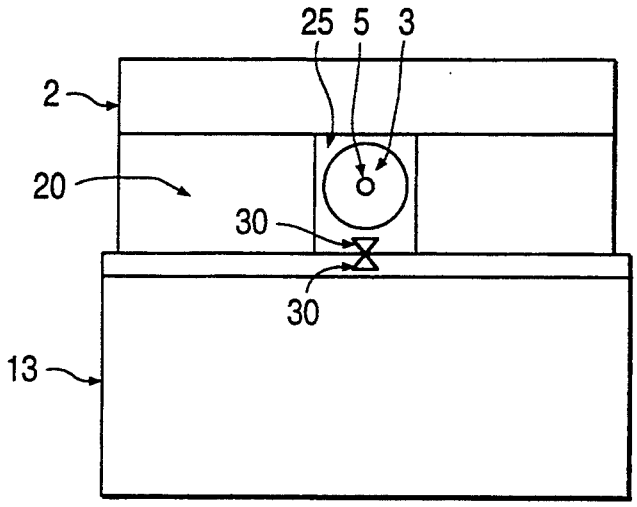

FIGS. 1, 1*a* and 1*b* show a first embodiment of the present invention. The actuator assembly of the first embodiment is indicated generally by reference numeral 1. Actuator assembly 1 includes a rotating spray head 2, which includes two spray nozzles 3 and 4. The exit orifices for spray nozzles 3 and 4 are indicated by reference numerals 5 and 6, respectively. Spray head flow passages 7 and 8 lead to spray nozzles 3 and 4, respectively, and allow the passage of pressurized fluid out exit orifices 5 and 6.

Spray head 2 is rotatably mounted on a hub assembly 9, which includes a spindle 10 upon which spray head 2 rotates. Spindle 10 includes a spindle flow passage 11 extending through it, spindle flow passage 11 allowing the passage of fluid to either of the spray head flow passages 7 or 8, depending on the orientation of the spray head 2. As shown in FIG. 1, the orientation of the spray head 2 is such that the spray head flow passage 7 is in communication with the spindle flow passage 11, and thus spray nozzle 5. The hub assembly is mounted on a piston stem 12, as used in a known spray dispensing pump, i.e., the pump disclosed in U.S. Pat. No. 4,389,003 to Philip Meshberg. The pump structure (not shown) used with the structure shown in FIGS. 1, 1*a* and 1*b* can correspond to the pump structure shown in U.S. Pat. No. 4,389,003 to Philip Meshberg, or any other known pump structure. A typical pump structure which may be used with all of the embodiments of the present invention is shown in the lower part of FIG. 3.

Hub assembly 9 has mounted thereon a dose adjustment ring 13. Dose adjustment ring 13 is mounted for limited rotating and reciprocal movement on hub assembly 9, so that the axial orientation of the dose adjustment ring 13 can be changed relative to the hub assembly 9. This is accomplished via a slot mechanism 14 in dose adjustment ring 13. Slot mechanism 14 includes an axial slot 15 and a plurality of circumferential slots 16. Included on hub assembly 9 is an adjustment tab 17, which is slidable in slots 15 and 16.

In operation of the device of FIGS. 1 and 1*a*, the user first selects which spray nozzle is desired. For example, one of the spray nozzles could be indicated as providing "coarse" spray, and the other spray nozzle indicating "fine" spray. The user would select the desired nozzle by rotating the spray head 2 on hub member 9 until indicia 30 on the two members are aligned, and the desired spray nozzle is selected. As shown in FIG. 1, when one spray nozzle 5 is exposed to the atmosphere, the other spray nozzle 6 is covered by a cover wall 20 on hub member 9. Cover wall 20 can extend circumferentially to the extent that there is a single opening 25 uncovering the spray nozzles 5 or 6 when the spindle flow passage 11 is aligned with either spray head flow passage 7 or 8, as shown in FIG. 1*b*.

Once the user selects a desired spray nozzle, the user would then select the desired dosage. Dosage is selected by adjusting the dose adjustment ring 13. FIG. 1 shows the dose adjustment ring adjusted for maximum dosage, i.e., with tab 17 in the lowermost circumferential slot 16. This location allows the greatest distance 21 between the bottom of the dose adjustment ring 13 and the top of the mounting cup 22. The distance 21 corresponds to the stroke of the attached pump (not shown)—the pump actuator 1 will travel this distance before being stopped by contact between the dose adjustment ring 13 and the mounting cup 22. For a smaller dose, the user would rotate the dose adjustment ring 13 until tab 17 is aligned in slot 15 and then slide dose adjustment ring 13 downward and then circumferentially so that tab 17 is aligned in one of the upper slots 16. This movement will result in a movement down of the bottom surface of dose adjustment ring 13, decreasing the distance 21, and thus decreasing the dose of the pump. Dose adjustment ring 13 could be adjusted by other means as well, for example cooperating screw threads on dose adjustment ring 13 and hub 9, or other alternative and equivalent means of adjusting the axial location of the dose adjustment ring 13 on the hub 9.

Figure 2:
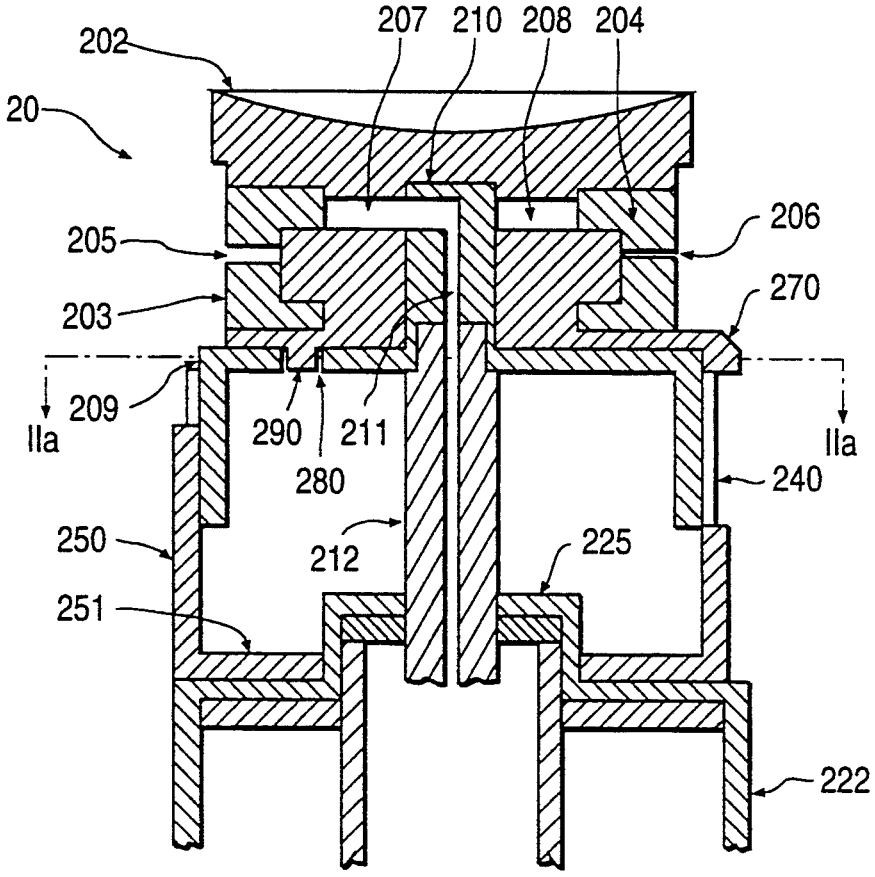
FIG. 2 shows a cross-sectional view of a second embodiment of the present invention.
Figure 2A:
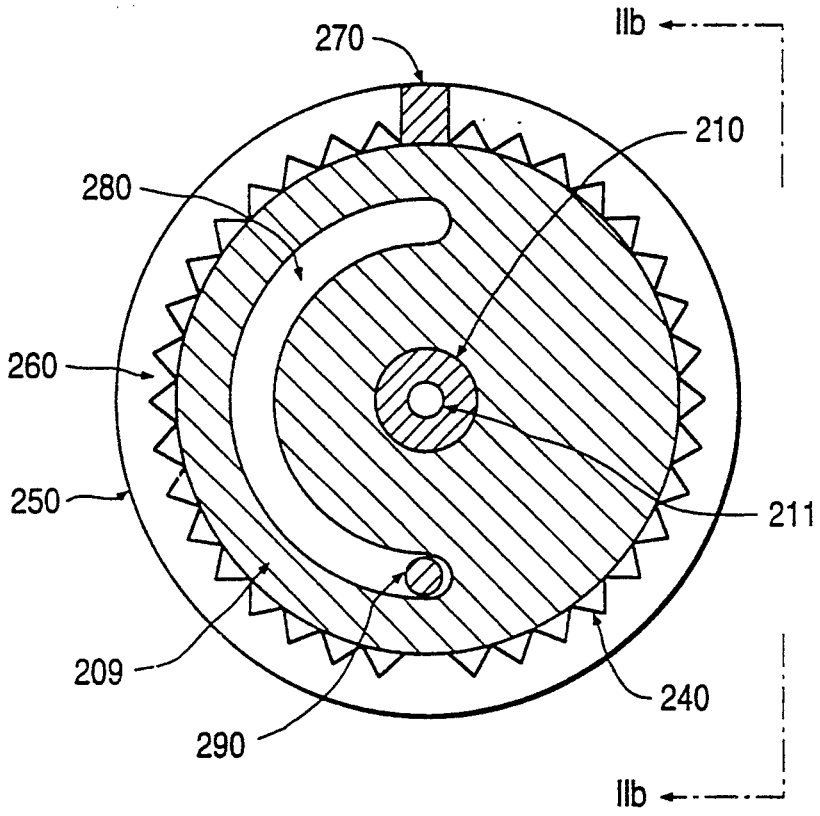
FIG. 2*a* shows a further cross-sectional view of the second embodiment of the present invention.
Figure 2B:
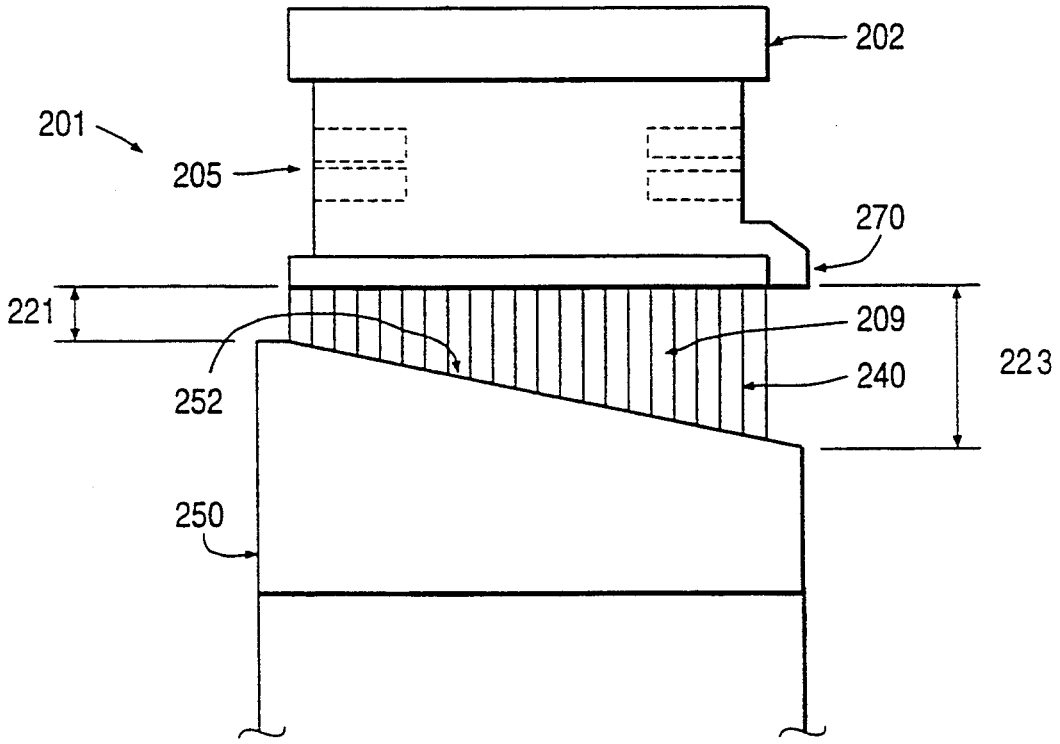
FIGS. 2*b* and 2*c* show different positions of the spray head, in an unactuated position, of the second embodiment of the present invention.
Figure 2C:
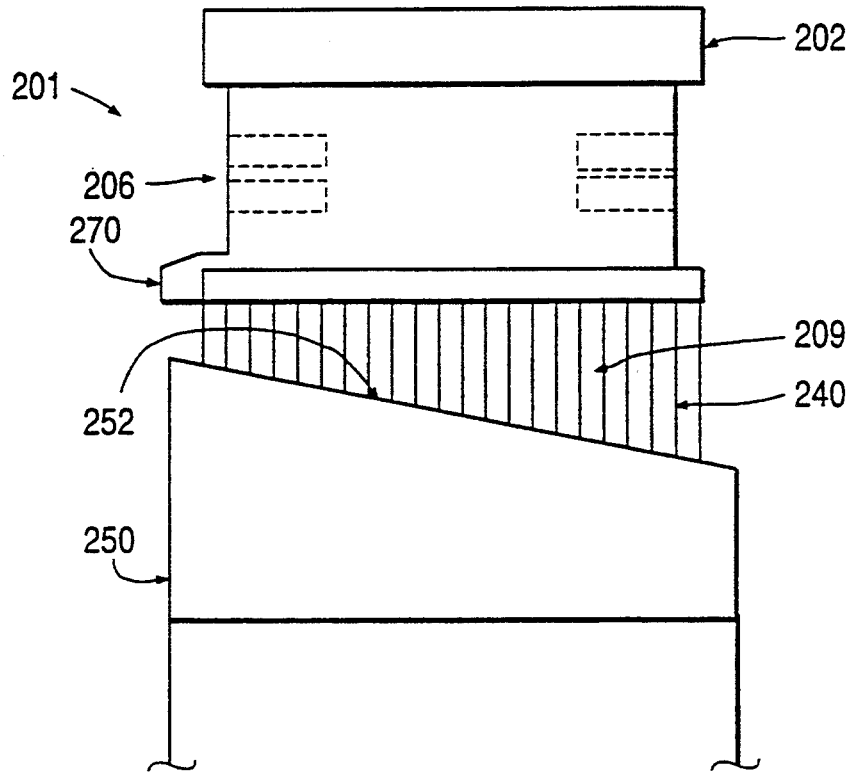
Figure 2D:
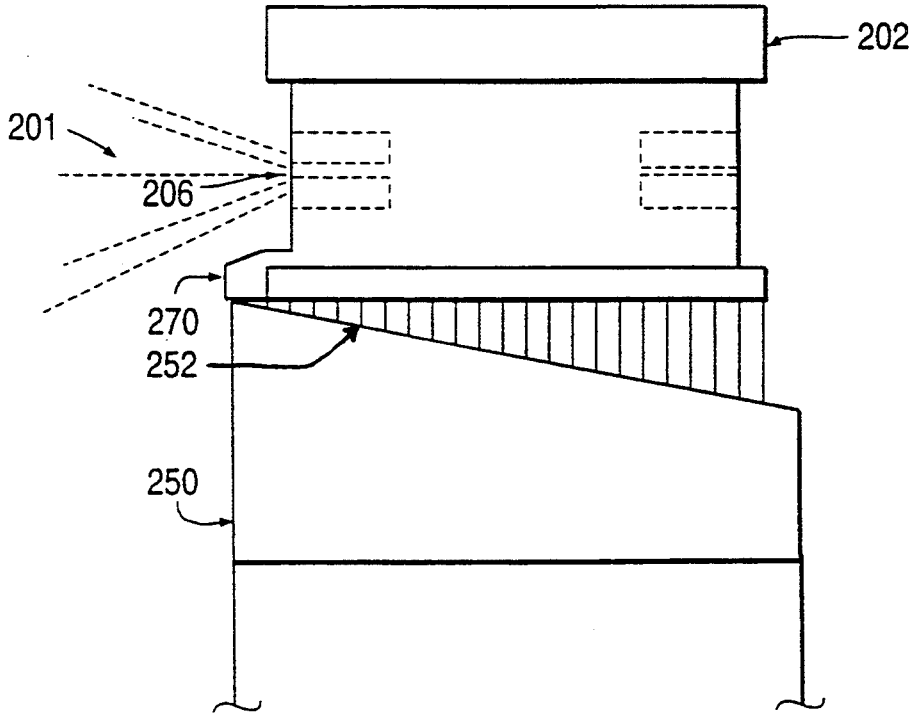
FIGS. 2*d* and 2*e* show different positions of the spray head, in an actuated position at the bottom of the pump stroke, of the second embodiment of the present invention.
Figure 2E:
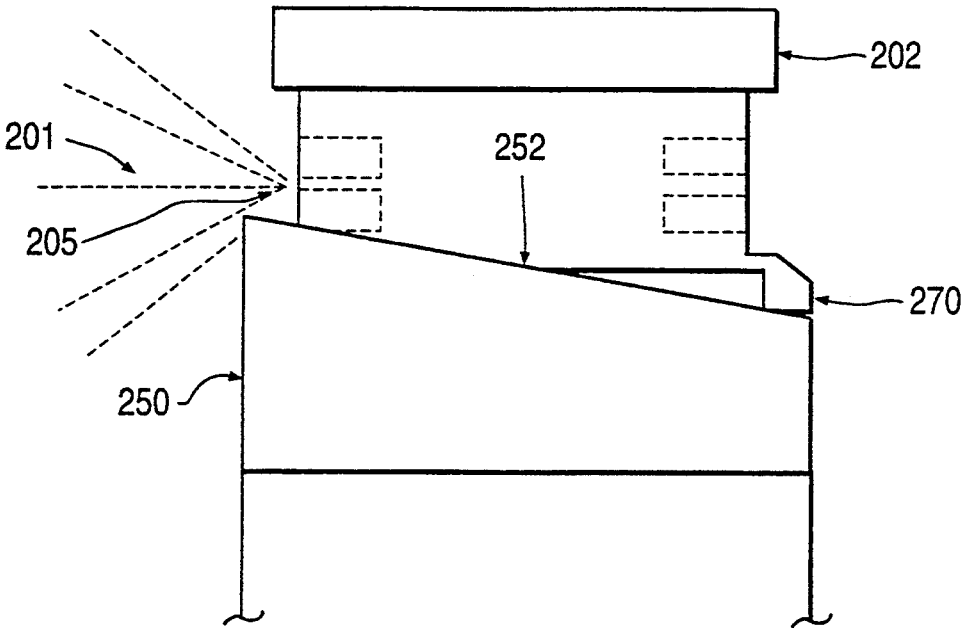

FIGS. 2–2*e* show a second embodiment of the present invention. The actuator assembly of the first embodiment is indicated generally by reference numeral 201. Actuator assembly 201 includes a rotating spray head 202, which includes two spray nozzles 203 and 204. The exit orifices for spray nozzles 203 and 204 are indicated by reference numerals 205 and 206, respectively. Spray head flow passages 207 and 208 lead to spray nozzles 203 and 204, respectively, and allow the passage of pressurized fluid out exit orifices 205 and 206. Spray head 202 also includes a radially-extending stop tab 270.

Spray head 202 is rotatably mounted on a hub assembly 209, which includes a spindle 210 upon which spray head 202 rotates. Spindle 210 includes a spindle flow passage 211 extending through it, spindle flow passage 211 allowing the passage of fluid to either of the spray head flow passages 207 or 208, depending on the orientation of the spray head 202. As shown in FIG. 2, the orientation of the spray head 202 is such that the spray head flow passage 207 is in communication with the spindle flow passage 211. The hub assembly is mounted on a piston stem 212, as used in a known spray dispensing pump, i.e., the pump disclosed in U.S. Pat. No. 4,389,003 to Philip Meshberg, or any other known pump structure. A typical pump structure which may be used with all of the embodiments of the present invention is shown in the lower part of FIG. 3.

Hub assembly 209 includes hub knurls 240 which extend from the outer circumferential surface of hub assembly 209. Hub knurls 240 cooperate with stop ring knurls 260 on the inner circumferential surface of stop ring 250. Stop ring 230 is fixedly mounted to mounting cup 222 via any suitable securing mechanism. As shown in FIG. 2, the securing mechanism is a flange 251 which is press fit onto an extended portion 225 of mounting cup 222. The upper surface 232 of stop ring 250 is angled, to provide different elevations for stop tab 270 to engage.

Hub assembly 209 also includes a guide groove 280 which extends a specified angular extent within the hub assembly. Spray head 202 includes a downwardly-projecting guide tab 290 which is guided within guide groove 280. The guide tab 290 and guide groove 280 are situated such that location of the guide tab 290 at one end of the guide groove 280 corresponds to the alignment of the spindle passage 211 with one of the spray head passages 207 or 208. Location of the guide tab 290 at the other end of the guide groove 280 corresponds to the alignment of the spindle passage 211 with the other of the spray head passages 207 or 208. Guide groove 280 and guide tab 290 thus act to assist in alignment of the spray head 202 in its proper position for spraying for either of the nozzles 205 or 206. Indicia can be used, either in combination with, or as an alternative to, guide groove 280 and guide tab 290 to indicate alignment of the spray head in its proper positions for spraying. The guide groove/guide tab combination shown in the embodiment of FIG. 2 could also be incorporated into the embodiment shown in FIGS. 1–1*b*.

In operation of the device of FIGS. 2—2*e*, the user first selects which spray nozzle is desired. For example, one of the spray nozzles could be indicated as providing "coarse" spray, and the other spray nozzle indicating "fine" spray. The user would select the desired nozzle by rotating the spray head 202 on hub member 209 until the guide tab 290 contacts an end of the guide groove 280, or alternatively indicia on the two members were aligned, and the desired spray nozzle was selected. In the device of FIGS. 2—2*e*, selection of a specific spray nozzle also results in a selection of the desired dosage, as will be explained below.

FIGS. 2*b* and 2*e* show the second embodiment of the present invention oriented for maximum dosage. FIG. 2*b* shows the device at the top of the stroke, and FIG. 2*e* at the bottom of the stroke. As can be seen in FIG. 2*e*, in the present invention downward movement of the spray head 202 will be stopped by contact between the stop tab 270 and the upper surface 252 of stop ring 250. The distance of the stroke in the position indicated in FIGS. 2*b* and 2*e* is indicated by the reference numeral 223 in FIG. 2*b*. FIGS. 2*c* and 2*d* show the second embodiment of the present invention oriented for minimum dosage. FIG. 2*c* shows the device at the top of the stroke, and FIG. 2*d* at the bottom of the stroke. Downward movement of spray head 202 is stopped by contact between the stop tab 270 and the upper surface 252 of stop ring 250. The distance of the stroke in the position indicated in FIGS. 2*c* and 2*d* is indicated by the reference numeral 223 in FIG. 2*b*.

Figure 3:
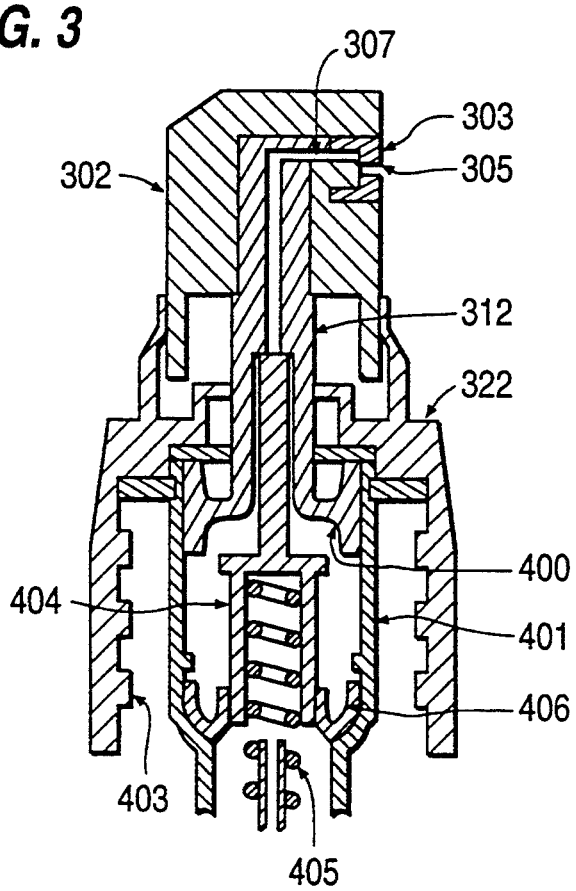
FIG. 3 shows a cross-sectional view of a third embodiment of the present invention, including the pump structure.
Figure 3A:
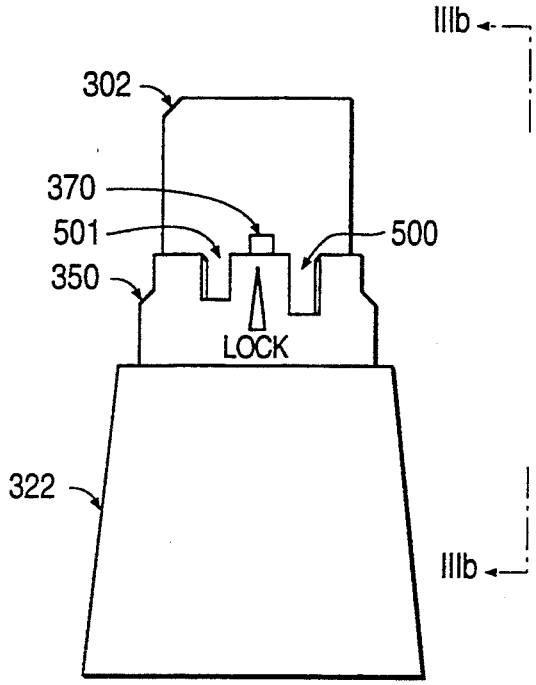
FIGS. 3*a* and 3*b* show side and front views, respectively, of the third embodiment of the present invention.
Figure 3B:
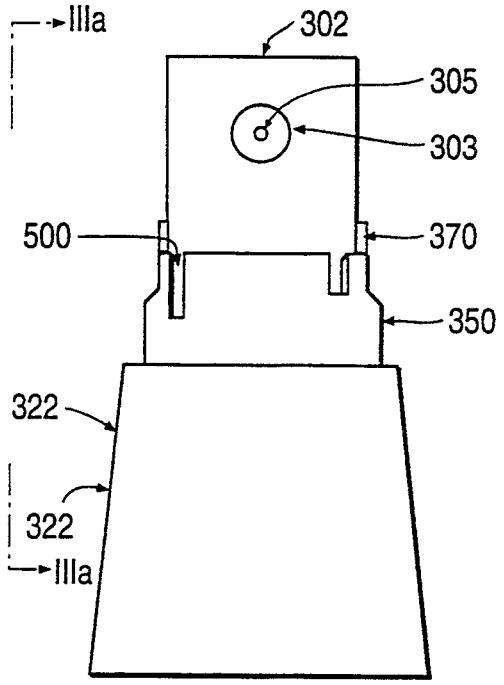
Figure 3C:
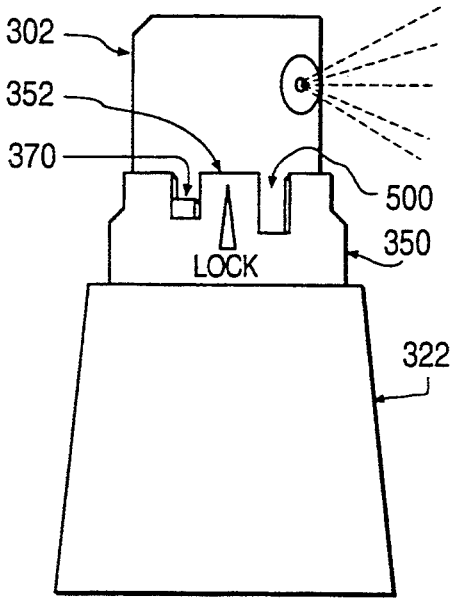
FIGS. 3*c* and 3*d* show different positions of the actuator, in an actuated position at the bottom of the pump stroke, of the third embodiment of the present invention.
Figure 3D:
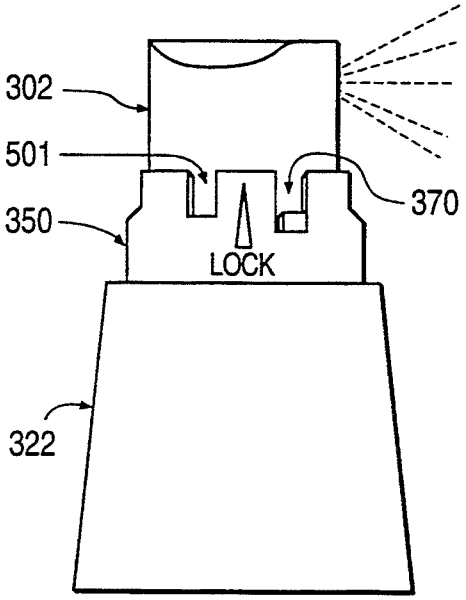

FIGS. 3—3*d* show a third embodiment of the present invention. As shown in FIG. 3, the third embodiment includes an actuator 302, which includes a spray nozzle 303 with outlet orifice 305. An actuator passage 307 communicates with the outlet orifice 305. Actuator 302 is mounted on a piston stem 312, which is part of a pump piston 400. Pump piston 400 slides within a pump housing 401, pump housing 401 being fixedly mounted in mounting cup 322. Mounting cup can include threads 403 for fastening to a container or bottle, or can be crimped onto a container or bottle. Other known methods of fastening the mounting cup to the bottle can also be used. The pump can include a spring-biased vane member 404, biased upwardly by a spring 405. Valve member 404 cooperates at its upper end with pump stem 312 to form a pressure-operated outlet valve, and cooperates with a sliding seal 406 at its lower end to form an inlet valve. The operation of the pump structure shown in FIG. 3 is described in detail in U.S. Pat. No. 4,389,003 to Philip Meshberg, the disclosure of which is incorporated herein by reference.

The operation of the variable dose mechanism of the third embodiment of the present invention can be seen with reference to FIGS. 3*a*–*d*. The actuator 302 includes one or more stop tabs 370 projecting radially from the outer circumferential surface of the actuator 302. Mounting cup 322 includes an upwardly-extending stop ring 350. Stop ring 350 includes a plurality of stop slots 500, 501, each having a different depth. Stop ring 350 also includes an upper surface 352 which acts as a locking mechanism for the actuator 302.

In operation of the device of the third embodiment of the present invention, actuator 302 is rotated until the stop tab 370 is located directly above one of the stop slots 500 or 501. Actuator 302 is depressed, allowing dispensing out spray nozzle 303 until the stop tab 370 contacts the bottom of the stop slot. The depth of the stop slot in which the stop tab 370 reciprocates will define the length of the pump stroke, and thus the dose dispensed per actuation. FIG. 3*c* shows the device of the third embodiment when a small dose is desired; FIG. 3*d* shows the device of the third embodiment when a larger dose is desired. After the desired dose or doses are dispensed, the actuator 302 can be rotated so that the stop tab 370 is directly above upper surface 352.

This position acts as a "lock" position, preventing any downward actuation of the actuator 302.

Although in the depiction in FIGS. 3—3*d* shows an actuator with two stop tabs 370 and two different sized stop slots 500, 501, the device could alternatively include one stop tab 370 and any number of stop slots 500, 501, etc., of varying depths around the circumference of the stop ring 350.

I claim:

1. A dispensing pump comprising:

a pump housing;

a pump piston slidably mounted for axially reciprocal movement in said pump housing, said pump piston comprising a piston flow passage;

a mounting cup connected to said pump housing, said mounting cup having an axially-outwardly facing stop surface; and a dispensing actuator mounted to said pump piston, said dispensing actuator comprising:

a first spray nozzle and a second spray nozzle;

a first actuator flow passage leading to said first spray nozzle and capable of communication with said piston flow passage in one position of said dispensing actuator, and a second actuator flow passage leading to said second spray nozzle and capable of communication with said piston flow passage in another position of said dispensing actuator; and an adjustable stop member movable to a plurality of positions, wherein in a first position of said stop member, downward movement of said dispensing actuator allows said pump piston to move axially inwardly in said pump housing a first predetermined distance before said adjustable stop member contacts said stop surface, and wherein in a second position of said stop member, downward movement of said dispensing actuator allows said pump piston to move axially inwardly a second predetermined distance before said adjustable stop member contacts said stop surface, said second predetermined distance being smaller than said first predetermined distance.

2. The dispensing pump of claim 1, wherein:

said mounting cup comprises an axially-outwardly projecting stop ring, said stop surface being the axially-outward surface of said stop ring.

3. The dispensing pump of claim 2, wherein:

said stop surface is slanted.

4. The dispensing pump of claim 2, wherein:

said dispensing actuator comprises:

a spray head and a hub member, said spray head comprising said first and second spray nozzles and said first and second actuator flow passages, said hub member comprising a spindle, said spray head being rotatably mounted on said spindle.

5. The dispensing pump of claim 4, wherein:

said hub member comprises knurls on a radially outer surface, said stop ring comprising knurls on a radially inner surface, said knurls on said hub member and said knurls on said stop ring cooperating to prevent rotation of said hub member when said spray head is rotated on said spindle.

6. The dispensing pump of claim 4, wherein:

said hub member comprises a guide groove and said spray head comprises a guide tab, said guide tab being guided in said guide groove, wherein contact between said guide tab and an end of said guide groove corresponds to said one position of said dispensing actuator.

7. The dispensing pump of claim 6, wherein:

contact between said guide tab and another end of said guide groove corresponds to said another position of said dispensing actuator.

8. The dispensing pump of claim 4; wherein: said stop member is mounted on said spray head.

9. The dispensing pump of claim 1, wherein:

said dispensing actuator comprises:

a spray head and a hub member, said spray head comprising said first and second spray nozzles and said first and second actuator flow passages, said hub member comprising a spindle, said spray head being rotatably mounted on said spindle.

10. The dispensing pump of claim 9, wherein:

said stop member is mounted for axial movement on said hub member.

11. The dispensing pump of claim 10, wherein:

said stop member comprises a guide groove and said hub member comprises a guide tab guided in said guide groove, wherein movement of said guide tab within said guide groove results in axial movement of stop member relative to said hub member.

12. The dispensing pump of claim 1, wherein:

said hub member comprises a cover wall which covers said the other of said nozzle or second nozzle when one of said nozzle or said second nozzle is in communication with said piston flow passage.

13. A dispensing head comprising:

an actuator, said actuator comprising first and second actuator flow passages, said actuator further comprising at least one stop member;

a first spray nozzle mounted in said actuator, said first spray nozzle comprising a first spray orifice in communication with said first actuator flow passage in one position of said actuator, and a second spray nozzle mounted in said actuator, said second spray nozzle comprising a second spray orifice in communication with said second actuator flow passage in another position of said actuator; and a mounting cup, said actuator being mounted for reciprocal movement relative to said mounting cup, said mounting cup comprising a stop ring having a stop surface of differing axial elevation, wherein said stop member is mounted for contact with said stop surface such that the stop surface limits the axially inward reciprocal movement of said actuator relative to said mounting cup, the limit of said inward movement being defined by the axial elevation of said stop surface.

14. The dispensing head of claim 13, wherein:

said stop surface is slanted.

15. The dispensing head of claim 13, wherein:

said actuator comprises:

a spray head and a hub member, said spray head comprising said first and second spray nozzles and said first and second actuator flow passages, said hub member comprising a spindle, said spray head being rotatably mounted on said spindle.

16. The dispensing head of claim 15, wherein:

said hub member comprises knurls on a radially outer surface, said stop ring comprising knurls on a radially inner surface, said knurls on said hub member and said knurls on said stop ring cooperating to prevent rotation of said hub member when said spray head is rotated on said spindle.

17. The dispensing head of claim 15, wherein:

said hub member comprises a guide groove and said spray head comprises a guide tab, said guide tab being guided in said guide groove.

18. The dispensing pump of claim 15, wherein:

said stop member is mounted on said spray head.

* * * * *

UNITED STATES PATENT AND TRADEMARK OFFICE

CERTIFICATE OF CORRECTION

PATENT NO. : 5,363,992

DATED : November 15, 1994

INVENTOR(S) : Philip Meshberg

It is certified that error appears in the above-indentified patent and that said Letters Patent is hereby corrected as shown below:

| Column | Line | |
|---|---|---|
| 3 | 34 | Change "230" to --250--. |
| 3 | 38 | Change "232" to --252--. |
| 4 | 36 | Change "vane" to --valve--. |

Signed and Sealed this

Eleventh Day of April, 1995

*Attest:*

Bruce Lehman

BRUCE LEHMAN

*Attesting Officer*

*Commissioner of Patents and Trademarks*